US010092815B1

(12) United States Patent
Faber

(10) Patent No.: US 10,092,815 B1
(45) Date of Patent: Oct. 9, 2018

(54) SNOWSHOE-SKI KIT AND METHOD OF ADJUSTING THE EFFECTIVE TRACTION COEFFICIENT ON A SNOWSHOE-SKI

(71) Applicant: FABER ET CIE INC., Quebec (CA)

(72) Inventor: Guy Faber, Quebec (CA)

(73) Assignee: FABER ET CIE INC., Quebec (Quebec) (CA)

( * ) Notice: Subject to any disclaimer, the term of this patent is extended or adjusted under 35 U.S.C. 154(b) by 3 days.

(21) Appl. No.: 15/802,618

(22) Filed: Nov. 3, 2017

(51) Int. Cl.

| | |
|---|---|
| ***A63C 5/00*** | (2006.01) |
| ***A63C 5/04*** | (2006.01) |
| ***A63C 9/00*** | (2012.01) |
| ***A63C 13/00*** | (2006.01) |

(52) U.S. Cl.
CPC ..... *A63C 5/0417* (2013.01); *A63C 5/003* (2013.01); *A63C 9/00* (2013.01); *A63C 13/001* (2013.01); *A63C 13/005* (2013.01)

(58) Field of Classification Search
None
See application file for complete search history.

(56) References Cited

U.S. PATENT DOCUMENTS

| | | | |
|---|---|---|---|
| 1,783,833 | A | 12/1930 | Elsner |
| 2,149,585 | A | 3/1939 | Dawson |
| 2,162,888 | A | 6/1939 | Held et al. |
| 2,189,760 | A | 2/1940 | Matthee et al. |
| 2,287,252 | A | 6/1942 | Kaufmann |
| 2,326,802 | A | 8/1943 | Robinson et al. |
| 2,358,213 | A | 9/1944 | Courage |
| 3,506,279 | A | 4/1970 | Lambert |
| 4,165,886 | A | 8/1979 | Nussbaumer |
| 4,564,210 | A | 1/1986 | Case |
| 4,666,178 | A | 5/1987 | Matthews |
| 5,052,708 | A | 10/1991 | Matthews |

(Continued)

FOREIGN PATENT DOCUMENTS

| | | |
|---|---|---|
| CH | 710168 A2 | 3/2016 |
| CH | 710338 A2 | 5/2016 |

(Continued)

*Primary Examiner* — John D Walters
*Assistant Examiner* — Hilary L Johns
(74) *Attorney, Agent, or Firm* — Shumaker, Loop & Kendrick, LLP; James D. Miller

(57) ABSTRACT

A snowshoe-ski kit comprising a hybrid snowshoe-ski comprising a main body defining a bottom surface operative for moving over snow and having a snowshoe-ski traction coefficient, and a top surface opposite the bottom surface. The hybrid snowshoe-ski further comprises a binding attached to the main body for attachment to a person's foot atop the top surface. The kit also comprises a first removable and reversible sheet-like skin having opposite first and second surfaces each defining respective first and second skin traction coefficients that differ from each other and that differ from the snowshoe-ski bottom surface traction coefficient. The first skin is removably attachable to the snowshoe-ski main body with either one of the first and second surfaces bearing against the bottom surface and the other one of the first and second surfaces being exposed, for allowing the snowshoe-ski to be operatively used either alone or with the first skin installed with either one of the first and second skin surfaces exposed.

15 Claims, 6 Drawing Sheets

(56) References Cited

U.S. PATENT DOCUMENTS

| | | | | |
|---|---|---|---|---|
| 6,105,990 | A | 8/2000 | Sutherland | |
| 6,264,215 | B1 | 7/2001 | Carlson et al. | |
| 6,471,234 | B2 | 10/2002 | Ayliffe | |
| 6,604,755 | B2 | 8/2003 | Ayliffe et al. | |
| 6,659,492 | B2 * | 12/2003 | Gousie | A63C 5/00 280/604 |
| 6,837,512 | B2 | 1/2005 | Long | |
| 7,287,775 | B2 | 10/2007 | Walker et al. | |
| 7,540,525 | B2 | 6/2009 | Ametsbichler et al. | |
| 7,543,839 | B2 | 6/2009 | Hartmann | |
| 7,681,904 | B2 | 3/2010 | Ekberg | |
| 8,474,853 | B2 | 7/2013 | Rogers et al. | |
| 8,590,936 | B2 | 11/2013 | Payson | |
| 8,844,963 | B2 | 9/2014 | McCrank et al. | |
| 9,027,951 | B2 * | 5/2015 | Holzer | A63C 7/02 280/604 |
| 9,126,096 | B2 | 9/2015 | Puelacher | |
| 2006/0267332 | A1 | 11/2006 | Fischli | |
| 2007/0246913 | A1 | 10/2007 | Coulbourn | |
| 2008/0023956 | A1 | 1/2008 | Fischli | |
| 2008/0185817 | A1 | 8/2008 | Gyr | |
| 2010/0239808 | A1 | 9/2010 | Schwitter | |
| 2012/0161422 | A1 * | 6/2012 | Elliott | A63C 7/04 280/604 |
| 2012/0161423 | A1 * | 6/2012 | Elliott | A63C 7/04 280/604 |
| 2016/0213997 | A1 | 7/2016 | Holovicz | |

FOREIGN PATENT DOCUMENTS

| | | | |
|---|---|---|---|
| DE | 102013219934 | A1 | 4/2015 |
| DE | 102015006121 | A1 | 11/2016 |
| EP | 2745886 | A1 | 6/2014 |
| EP | 2835156 | A1 | 2/2015 |
| FR | 2994099 | A1 | 2/2014 |
| FR | 3016528 | A1 | 7/2015 |
| FR | 3018456 | A1 | 9/2015 |
| FR | 3019754 | A1 | 10/2015 |

* cited by examiner

SNOWSHOE-SKI KIT AND METHOD OF ADJUSTING THE EFFECTIVE TRACTION COEFFICIENT ON A SNOWSHOE-SKI

FIELD OF THE INVENTION

The present invention relates to hybrid snowshoe-skis, and more particularly to a snowshoe-ski kit that includes a hybrid snowshoe-ski that has a traction coefficient, and a pair of skins each having two surfaces with respective traction coefficients, with the skins being reversible and attachable to the snowshoe-ski each on either side such that the snowshoe-ski can be used alone or with the skins with either side exposed for providing different selectable effective traction coefficients to the snowshoe-ski.

BACKGROUND OF THE INVENTION

Regular snowshoes are difficult to use as skis because they are inherently built for traction on snow and as such they will not slide on snow easily as is expected from skis. While climbing is easier with snowshoes, moving along flat ground or downhill is only about as efficient as walking uphill.

Skis, on the other hand, have the opposite characteristics: they slide well which facilitates some displacements on flat ground and which makes sliding downhill easier in some circumstances also such as in man-made ski trails, but provide little traction such that climbing hills is more difficult. However, even when moving downhill, such as in off-trail situations, sliding is sometimes not desirable especially on steep slopes where a controlled descent is desired.

It is known to provide skins for skis, for example made of seal skins, with the naturally inclined fur of the skin being oriented towards the rear of the ski such that it will not hinder forward sliding movement of the ski bottom surface on the snow, but will provide traction during backward movement of the ski along the snow, consequently providing traction for forward movement on ground of any inclination, but being mostly useful when climbing; while not hindering forward movement and sliding downhill. However such skins are not adapted for providing traction for enhanced control during downhill movement, notably. Control during downhill movement with skis is usually obtained by means of the longitudinal steel edges that are provided on each side of the skis through controlled lateral deportation of the skis.

Hybrid snowshoe-skis are known that allow both skiing and walking as snowshoes. However, known hybrid snowshoe-skis either slide too much if they are closer to skis in their parameters, or provide too much traction if they are closer to snowshoes in their parameters.

The problem is ultimately that the terrain type that is being travelled over will vary, from uphill to downhill to flat ground, from steep to mild slopes, from one type of snow to another, from open ground to clustered forests, and so on. One type of ski, snowshoe or snowshoe-ski might be adapted for or advantageously used in one terrain type, but it will inevitably fall short of being efficient or pleasant on another terrain type. Even using skins such as seal skins described above does not offer the thusly equipped skis with enough versatility to adapt to the vast diversity of winter terrain that can be encountered.

SUMMARY OF THE INVENTION

The present invention relates to a snowshoe-ski kit comprising:

a hybrid snowshoe-ski comprising a main body defining a front end, a rear end, a bottom surface operative for moving over snow and having a snowshoe-ski traction coefficient, and a top surface opposite the bottom surface, said hybrid snowshoe-ski further comprising a binding attached to said main body for attachment to a person's foot atop the top surface; and a first removable and reversible sheet-like skin having opposite first and second surfaces each defining respective first and second skin traction coefficients that differ from each other and that differ from the snowshoe-ski bottom surface traction coefficient; wherein the first skin is removably attachable to the snowshoe-ski main body with either one of the first and second surfaces bearing against the bottom surface and the other one of the first and second surfaces being exposed, for allowing the snowshoe-ski to be operatively used either alone or with the first skin installed with either one of the first and second skin surfaces exposed.

In one embodiment, the main body comprises a frame and a decking carried by the frame, the binding being attached to one or both of the decking and the frame and the first skin being removably attachable to one or both of the decking and the frame.

In one embodiment, the snowshoe-ski traction coefficient is lower than the traction coefficients of the first skin first and second surfaces for allowing sliding on snow when the snowshoe-ski is used without the first skin and for allowing a selectable enhanced traction when said snowshoe-ski is equipped with the first skin with either one of its first and second surfaces being exposed.

In one embodiment, the first skin is flexible and can conform to the shape of the bottom surface of the decking.

In one embodiment, the snowshoe-ski kit further comprises a second removable and reversible sheet-like skin having opposite first and second surfaces each defining respective first and second skin traction coefficients that differ from each other and that differ from the snowshoe-ski bottom surface traction coefficient, wherein the second skin is removably attachable to the snowshoe-ski main body with either one of the first and second surfaces bearing against the decking bottom surface and the other one of the first and second surfaces being exposed, for allowing the snowshoe-ski to be operatively used either alone, or with one or both the first and second skins being installed, with each of the first and second skins that is installed having one of their respective first and second skin surfaces exposed.

In one embodiment, said first and second skins are attachable to said snowshoe-ski in spaced apart configuration respectively frontwardly and rearwardly of the binding.

In one embodiment, the snowshoe-ski comprises a keel member on the bottom surface and the first skin is attachable at least partly to the keel member.

In one embodiment, the snowshoe-ski kit further comprises a first clip that is releasably attachable to both the first skin and the decking to attach the first skin to the decking.

In one embodiment, the decking comprises at least one decking opening to accommodate the first clip that is resiliently engageable within the decking opening, and the first skin comprises at least one first skin opening to accommodate the first clip that is resiliently engageable within the first clip opening.

In one embodiment, the first clip can be releasably connected to the first skin independently of the decking such that the first skin and first clip can be manipulated as a unit before the first skin is releasably attached to the snowshoe-ski.

In one embodiment, the snowshoe-ski comprises a keel member on the bottom surface and the first skin and second skins are attached at least partly to the keel member.

In one embodiment, the snowshoe-ski kit further comprises first and second clips that are releasably attachable to the decking and respectively to the first and second skins.

In one embodiment, the decking comprises decking openings to accommodate the first and second clips that are resiliently engageable within the decking openings, and the first and second skins comprise respective first and second skin openings to accommodate the first and second clips that are resiliently engageable within the first and second clip openings.

In one embodiment, the first and second clips can be releasably connected respectively to the first and second skins independently of the decking such that the first skin and the first clip can be manipulated as a first unit, and the second skin and the second clip can be manipulated as a second unit, before the first and second skins are releasably attached to the snowshoe-ski.

In one embodiment, the keel member comprises two spaced apart keel segments located on the decking bottom surface in spaced-apart configuration respectively frontwardly and rearwardly of the binding, with the first and second skins being attachable to a respective one of the first and second keel segments.

The present invention also relates to a method of adjusting the effective traction coefficient on a snowshoe-ski with a first sheet-like skin, the snowshoe-ski comprising a main body defining a front end, a rear end, a bottom surface operative for moving over snow and having a snowshoe-ski traction coefficient, and a top surface opposite the bottom surface, the snowshoe-ski further comprising a binding attached to the main body for attachment to a person's foot atop the top surface, the skin having opposite first and second surfaces each defining respective first and second skin traction coefficients that differ from each other and that differ from the snowshoe-ski bottom surface traction coefficient, the first skin being removably attachable to said snowshoe-ski with either one of the first and second skin surfaces bearing against the bottom surface and the other one of the first and second surfaces being exposed, the method comprising:

selecting whether to install the first skin on the snowshoe-ski;

if it is selected not to install the first skin to the snowshoe-ski, the snowshoe-ski is operatively used alone, wherein the effective traction coefficient is the snowshoe-ski traction coefficient; and if it is selected to install the first skin to the snowshoe-ski, the method further comprising:

selecting which of the first and second surfaces of the first skin will bear against the bottom surface; and removably attaching the first skin to the snowshoe-ski main body with the selected one of the first and second surface bearing against the bottom surface and with the other one of the first and second surfaces consequently being exposed, wherein the effective traction coefficient is influenced by both that of the exposed one among the first and second surfaces of the first skin and by the snowshoe-ski traction coefficient.

In one embodiment, the traction coefficients of the first and second surfaces of the first skin are higher than the snowshoe ski traction coefficient.

In one embodiment, during the step of selecting whether to install the first skin on the snowshoe-ski, the method further comprising selecting whether to install on the snowshoe-ski a second removable and reversible sheet-like skin having opposite first and second surfaces each defining respective first and second skin traction coefficients that differ from each other and that differ from the snowshoe-ski bottom surface traction coefficient, and if is selected to install the second skin to the snowshoe-ski, the method further comprising:

during the step of selecting which of the first and second surfaces of the first skin bears against the bottom surface, selecting which of the first and second surfaces of the second skin bears against the bottom surface; and during the step of removably attaching the first skin to the snowshoe-ski main body, removably attaching the second skin to the snowshoe-ski main body with its selected one among the first and second surfaces bearing against the bottom surface and with its other one of the first and second surfaces consequently being exposed, wherein the effective traction coefficient is additionally influenced by that of the exposed one among the first and second surfaces of the second skin.

In one embodiment, during the steps of removably attaching the first skin to the snowshoe-ski main body and of removably attaching the second skin to the snowshoe-ski main body, said first and second skins are attached in spaced apart configuration respectively frontwardly and rearwardly of the binding.

In one embodiment, the snowshoe-ski comprises a keel member having two keel segments on the bottom surface, and wherein during the steps of removably attaching the first skin to the snowshoe-ski main body and of removably attaching the second skin to the snowshoe-ski main body, the first skin is attached to said snowshoe-ski partly to one keel segment and is further releasably secured to the snowshoe-ski main body with a first attachment clip, and the second skin is attached to said snowshoe-ski partly to the other keel segment and is further releasably secured to the snowshoe-ski main body with a second attachment clip.

DETAILED DESCRIPTION OF THE EMBODIMENTS

Figure 1:
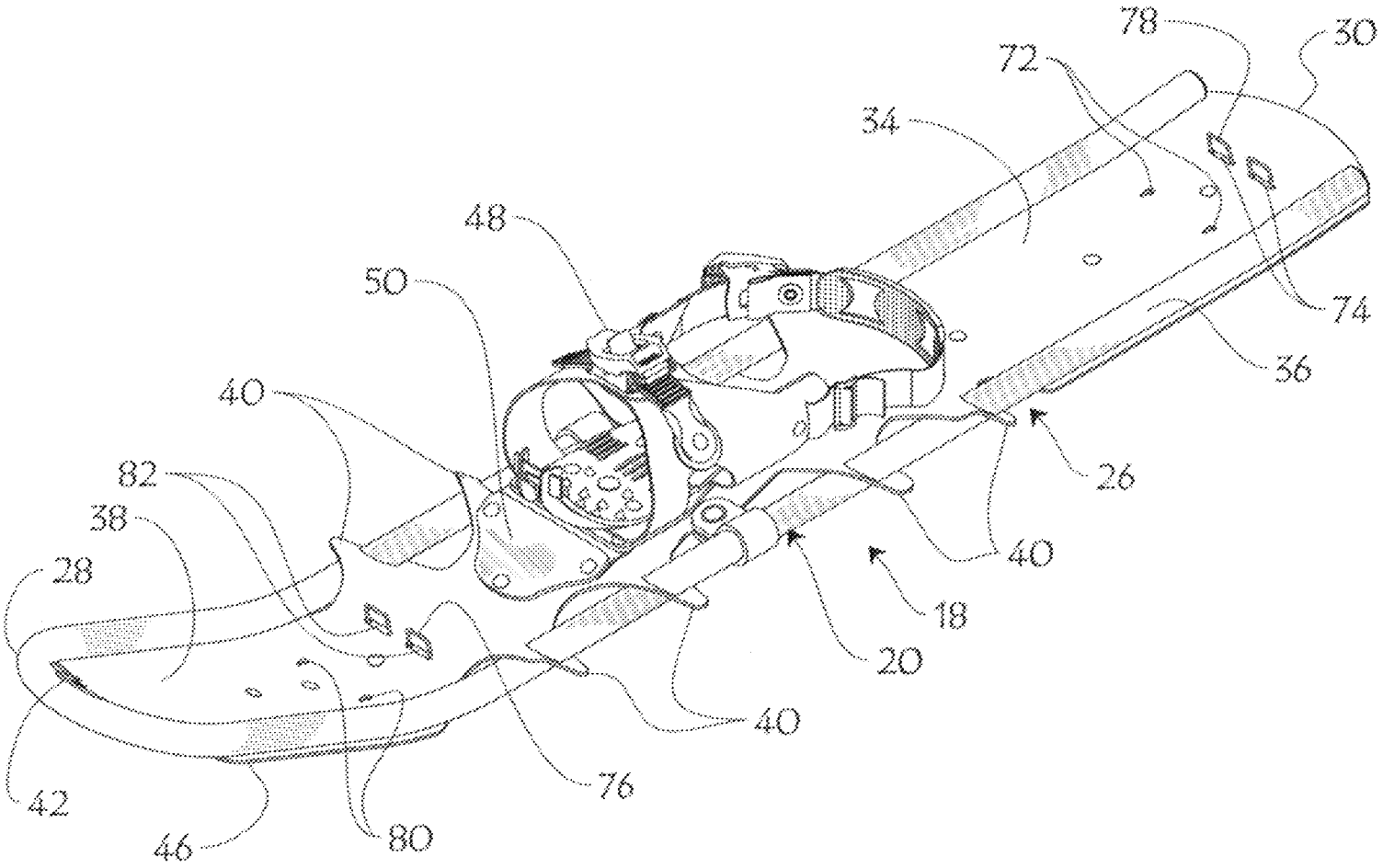
FIGS. 1 and 2 are respectively top and bottom perspective views of the snowshoe-ski kit of the present invention with the snowshoe-ski equipped with front and rear skins.
Figure 2:
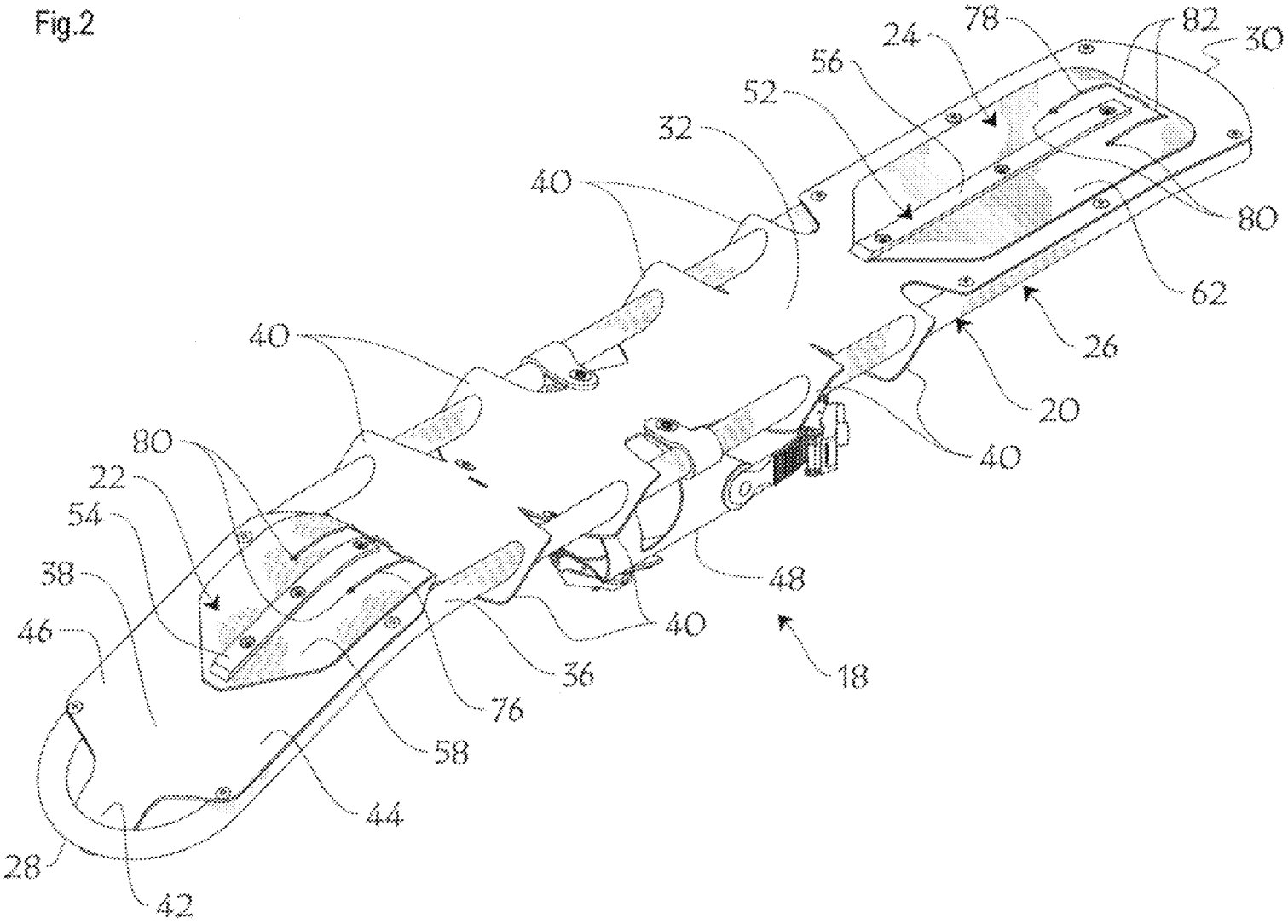
Figure 3:
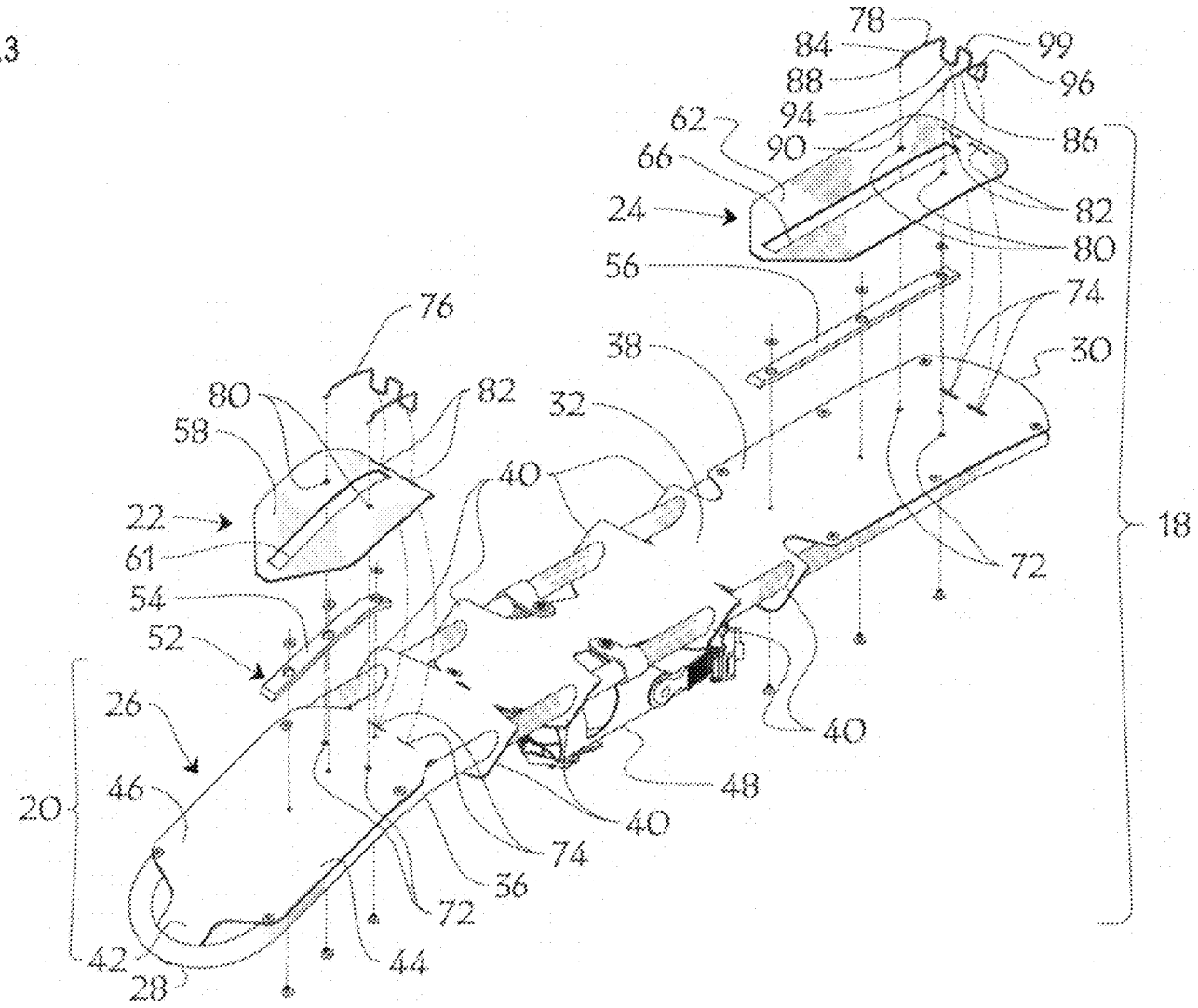
FIG. 3 is an exploded bottom perspective view of the snowshoe-ski kit of FIGS. 1-2.

FIGS. 1-3 show a snowshoe-ski kit 18 comprising a hybrid snowshoe-ski 20 and front and rear skins 22, 24. Front and rear skins 22, 24 can be installed on snowshoe-ski 20 or not, and if no skin 22, 24 is installed on snowshoe-ski 20, the latter can be used alone, as detailed hereinafter. The kit 20, 22, 24 can be sold with the skins 22, 24 installed to or separate from the snowshoe-ski 20.

Snowshoe-ski 20 comprises a main body 26 defining a front end 28, a rear end 30, a bottom surface 32 operative for moving over snow and having a snowshoe-ski traction coefficient, and a top surface 34 opposite the bottom surface 32. Main body 26 more particularly comprises a U-shaped frame 36 and a decking 38 carried by the frame by means of loops 40 that are formed integrally with decking 38 and that project sidewardly therefrom to be engaged by the tubular frame 36, and by means of tongues 42, 44, 46 that are riveted to frame 36 near the snowshoe-ski's front end 28. Loops 40 not only have the purpose of attaching decking 38 to frame 36, but also provide some traction to the snowshoe-ski 20 against backward movement while minimizing impediment to frontward sliding, due to them being inclined from the top and front towards the bottom and rear.

A binding 48 is attached to main body 26, and more particularly to decking 38 by means of a flexible live hinge 50, for attachment to a person's foot atop the top surface 34. It is understood that binding 48 could be attached to one or both of the decking 38 and the frame 36.

Snowshoe-ski 20 also comprises a keel member 52 on the bottom surface 32 of main body 26. More particularly keel member 52 comprises two aligned keel segments 54, 56 riveted to decking 38 in spaced-apart configuration respectively frontwardly and rearwardly of the binding 48. Keel member 52 is used to limit lateral shifting of the snowshoe-ski 20, especially when sliding at higher speed.

It is understood that other snowshoe-ski configurations could be envisioned, including but without being limited to ones where the frame is not U-shaped but rather forms a closed loop, where the decking has a different configuration, where the shape and relative size of the frame and decking differ, there the binding is different or is attached differently to the main body, where the keel member differs, and so on.

Figure 4B:
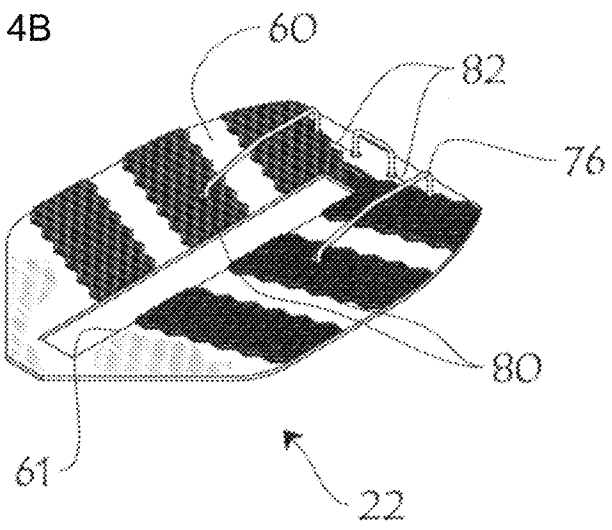
FIGS. 4A and 4B are enlarged perspective views respectively of the first and second surfaces of the front skin, with the first clip installed thereon.
Figure 4A:
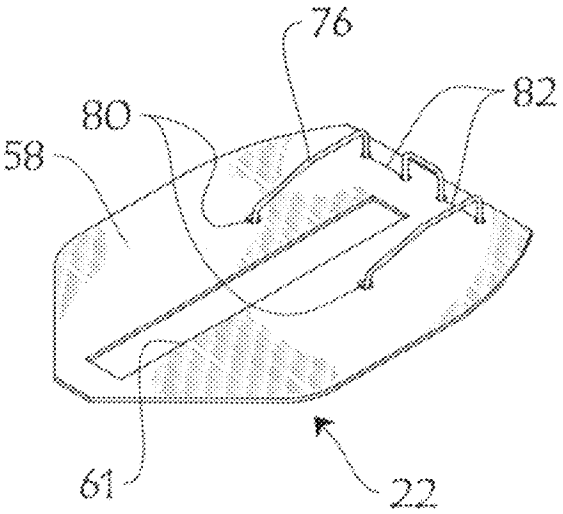

As further shown in FIGS. 4A and 4B, front skin 22 is removable, reversible and sheet-like and has opposite first and second surfaces 58, 60 each defining respective first and second skin traction coefficients that differ from each other and that differ from the snowshoe-ski bottom surface traction coefficient. More particularly the first and second surfaces 58, 60 have respective corrugations, ribs, grooves, patterns in relief, bosses, holes, apexes, bumps, ridges, or any other design or intrinsic material parameters that allow for a desired traction coefficient to be obtained. This traction coefficient can be quantifiable or not, in that a certain skin surface or material that promises or proves to provide certain traction characteristics does not need to have a specific number associated to its traction to allow one to differentiate it from the traction coefficient of a different type of surface. Front skin 22 also defines an elongated central slot 61.

The front skin 22 is removably attachable to the snowshoe-ski main body 26, and more particularly to decking 38, with either one of the first and second surfaces 58, 60 bearing against the bottom surface 34 and the other one of the first and second surfaces 58, 60 being exposed, for allowing the snowshoe-ski 20 to be operatively used either alone or with the front skin 22 installed with either one of the front and rear skin surfaces 58, 60 exposed, as will be detailed hereinafter. Front skin 22 is flexible and can conform to the shape of the bottom surface 34 of the decking 38: it can be seen that although decking 38 curves upwards towards the snowshoe-ski front end 28, and although it further undulates near the positions of tongues 40, front skin 22 snugly conforms to this curving and undulating shape of decking 38 due to its flexibility.

Figure 5A:
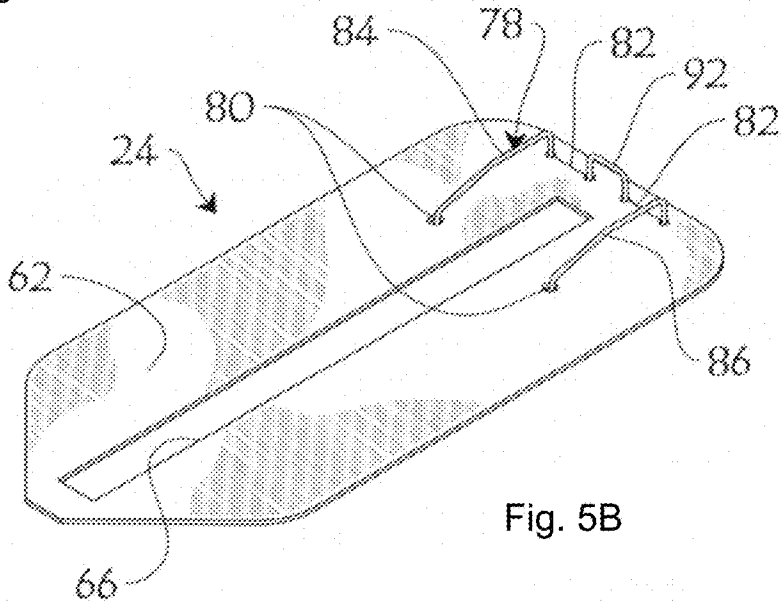
FIGS. 5A and 5B are enlarged perspective views respectively of the first and second surfaces of the rear skin, with the second clip installed thereon.
Figure 5B:
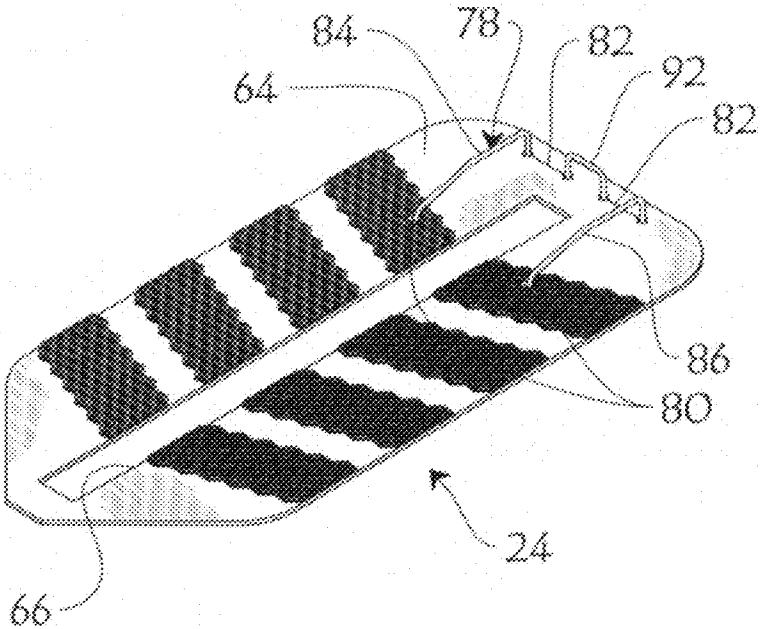
Figure 6A:
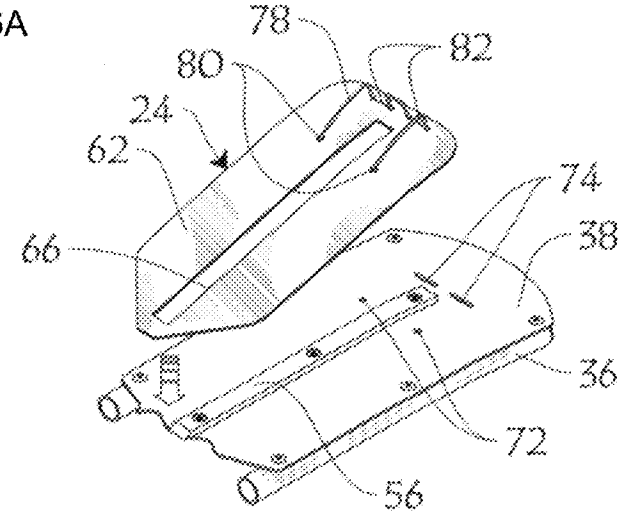
FIGS. 6A, 6B, 6C, 6D and 6E are enlarged partial perspective views of a rear portion of the snowshoe-ski kit of FIGS. 1-2, sequentially showing the installation of the rear skin to the snowshoe-ski with its first surface exposed.
Figure 6B:
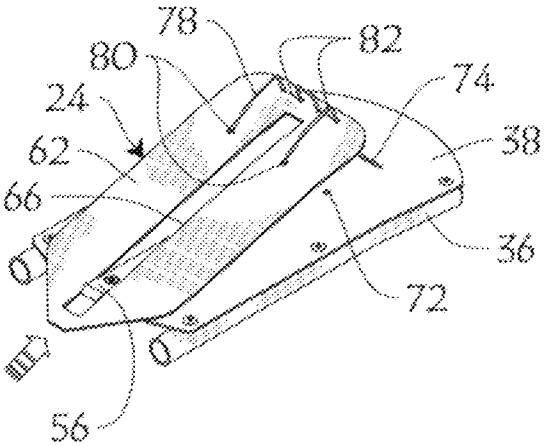
Figure 6C:
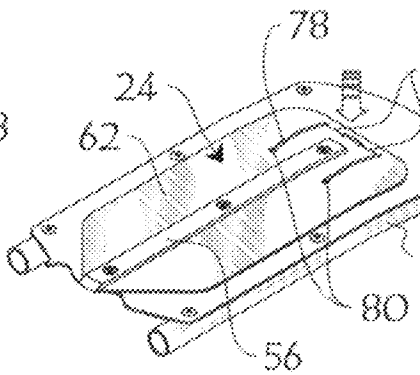
Figure 6D:
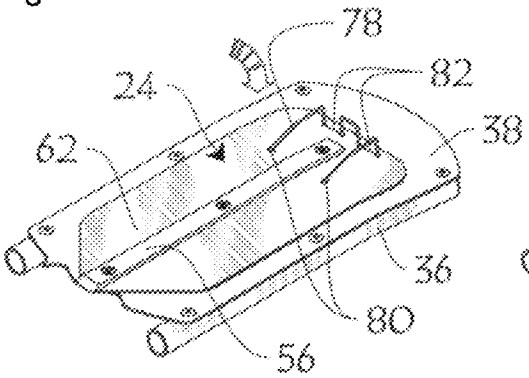
Figure 6E:
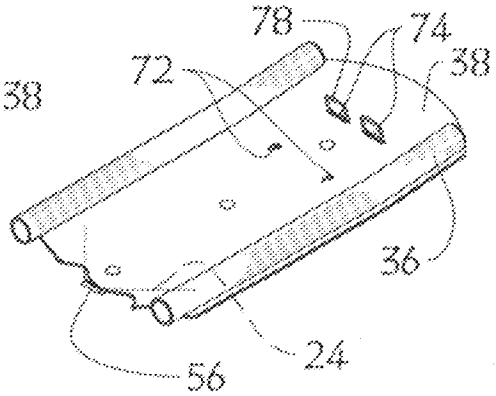

As further shown in FIGS. 5A and 5B, rear skin 24 is also removable, reversible and sheet-like and also has opposite first and second surfaces 62, 64 each defining respective first and second skin traction coefficients that differ from each other and that differ from the snowshoe-ski bottom surface traction coefficient. The respective traction coefficients of the first and second surfaces 62, 64 of rear skin 24 can respectively be identical, similar or different from the traction coefficients of the first and second surfaces 56, 58 of front skin 22. Like with the front skin 22, rear skin 24 is removably attachable to the snowshoe-ski main body 26 with either one of the first and second surfaces 62, 64 bearing against the decking bottom surface 32 and the other one of the first and second surfaces 62, 64 being exposed, for ultimately allowing the snowshoe-ski to be operatively used either alone, or with one or both the front and rear skins 22, 24 installed, with each of the front and rear skins 22, 24 that is installed having one of its respective front and rear skin surfaces 56, 58 and 62, 64 exposed, as detailed hereinafter. Rear skin 24 also defines an elongated central slot 66.

Rear skin 24 is flexible and can conform to the shape of the bottom surface 34 of the decking 38 like front skin 22, however in the embodiment shown in the drawings rear skin 24 is installed on a flat portion of decking 38.

Front and rear skins 22, 24 are attachable to snowshoe-ski 20 in spaced apart configuration respectively frontwardly and rearwardly of the binding 48, in a manner that will now be described. Reference is further made to FIGS. 6A-6E where the installation of read skin 24 is sequentially shown. Front and rear skins 22, 24 are attachable by engaging front keel segment 54 within front skin slot 61 and rear keel segment 56 within rear skin slot 66 and by tilting and/or bending the flexible front and rear skins 22, 24 and then sliding the front and rear skins rearwardly such that the front and rear keel segments 54, 56 will extend over the frontward edge of the front and rear skins 22, 24. Then front and rear skins 22, 24 are tilted or bent against the main body bottom surface 34 and releasably attached to snowshoe-ski 20 with clips 68, 70.

More particularly, snowshoe-ski kit 18 comprises first and second clips 68, 70 that are releasably attachable to decking 38 and respectively to the front and rear skins 22, 24. More particularly, decking 38 comprises decking openings in the form of holes 72 and slots 74 to accommodate first and second clips 76, 78 that are resiliently engageable within the decking openings 72, 74. The front and rear skins 22, 24 also comprise respective front and rear skin openings in the form of holes 80 and slots 82 to accommodate the first and second clips 76, 78 that are also resiliently engageable within the front and rear skin openings 80, 82. Each clip 76, 78, for example clip 78 shown in FIGS. 3, 5A, and 5B, is generally U-shaped and has two legs 84, 86 with hooked front extremities 88, 90 that are engageable in holes 72 and 80 and a bended M-shaped web portion 92 that can engage with two apexes 94, 96 the slots 74 and 82. The legs 84, 86 of the U-shaped clips 76, 78 will resiliently deform when web portion 92 is forced down to push apexes 94, 96 into slots 74, 82 to allow a resilient snap-fit engagement of clips 76, 78 with skins 22, 24 on the one hand, and with decking 38 on the other hand.

Furthermore, first and second clips 76, 78 can be releasably connected respectively to the front and rear skins 22, 24 independently of the decking 38 in a first step, such that the front skin 22 and the first clip 76 can be manipulated as a first unit, and the rear skin 24 and the second clip 78 can be manipulated as a second unit, before the front and rear skins 22, 24 are releasably attached to the snowshoe-ski 20 with clips 76, 78. This allows a much easier carrying, storage and, most importantly, installation of skins 22, 24 to decking 38 as the manipulation of each skin/clip unit 22, 76 and 24, 78 can easily be done manually even with a pair of winter gloves or mittens, without use of any tool whatsoever.

In use, the present invention relates to a method of adjusting the effective traction coefficient on snowshoe-ski 20 with a first sheet-like skin that can be either one of front and rear skins 22, 24. The method comprises first selecting whether to install the first skin 22 or 24 on the snowshoe-ski 20. If it is selected not to install the first skin 22 or 24 on the snowshoe-ski 20, the snowshoe-ski 20 can and will be operatively used alone, that is to say that the snowshoe ski main body's bottom surface 34 is operative for use in sliding on snow without any skin attached thereto. The effective traction coefficient is then, of course, the snowshoe-ski traction coefficient itself.

If it is selected to install the first skin 22 or 24 to the snowshoe-ski, the method further comprises selecting which of the first and second surfaces 58, 60, 62 or 64 of the first skin will bear against the main body's bottom surface 34; and then removably attaching as detailed above the first skin 22 or 24 to the snowshoe-ski main body with the selected one of the first and second surface 58, 60, 62 or 64 bearing against the bottom surface 34 and with the other one of the first and second surfaces 58, 60, 62 or 64 consequently being exposed. The effective traction coefficient is then influenced by both that of the exposed one among the first and second first skin first and second surfaces 58, 60, 62 or 64 and by the snowshoe-ski traction coefficient itself, since the selected skin 22 or 24 does not cover the entire snowshoe-ski bottom surface 34.

According to the method of the invention, during the step of selecting whether to install the first skin on the snowshoe-ski, one can further select whether to install on the snowshoe-ski 20 a second skin 22 or 24. In other words, either one, or both, skins 22, 24 can be installed on snowshoe-ski 20. If it is selected to install the second skin to the snowshoe-ski, the method further comprises, during the step of selecting which of the first and second surfaces 58, 60, 62 or 64 of the first 22 or 24 skin bears against the bottom surface, also selecting which of the first and second surfaces 58, 60, 62 or 64 of the second skin 22 or 24 bears against the bottom surface; and during the step of removably attaching the first skin 22 or 24 to the snowshoe-ski main body 26, removably attaching the second skin 22 or 24 to the snowshoe-ski main body 26 with its selected one among the first and second surfaces 58, 60, 62 or 64 bearing against the bottom surface 34 and with the other of the first and second surfaces 58, 60, 62 or 64 of the second skin 22 or 24 consequently being exposed. The effective traction coefficient is then additionally influenced by that of the exposed one among the first and second surfaces 58, 60, 62 or 64 of the second skin 22 or 24.

As can be seen in the drawings, during the steps of removably attaching the first skin 22 or 24 to the snowshoe-ski main body 26 and of removably attaching the second skin 22 or 24 to the snowshoe-ski main body 26, the first and second skins 22, 24 are attached in spaced apart configuration respectively frontwardly and rearwardly of the binding 48.

Concerning the snowshoe-ski traction coefficient, it is determined by that of the main body's lower surface 34 that is itself influenced by the lower surface of the decking 38, including loops 40, and of the frame 36. According to a preferred embodiment, the snowshoe-ski traction coefficient is lower than the traction coefficients of the first and second skin first and second surfaces 58, 60, 62, 64. This allows sliding on snow when the snowshoe-ski is used without the first and second skins 22, 24 and further allows a selectable enhanced traction when snowshoe-ski 20 is equipped with a single first skin 22 or 24, or with both the first and second skins 22 and 24; each with either one of their first and second surfaces 58, 60, 62 or 64 being exposed. This offers a wide variety of different effective traction coefficients, depending on whether snowshoe-ski 20 is used alone, with front skin 22 alone, with rear skin 24 alone, with both the front and rear skins 22, 24, and then in each of these combinations, whether each skin 22, 24 is used with its first or second surface 58, 60, 62 or 64 exposed. The snowshoe-ski kit 18 consequently allows snowshoe-ski 20 to become efficiently usable over a wide variety of snowy terrain.

According to the invention, snowshoe-ski kit 18 is advantageous because skins 22, 24 are small, light-weight and flexible, which makes them easy to carry in a small backpack or even in large coat pockets. With the clips 76, 78 being attachable to the skins 22, 24 to form skin/clip units 22, 76 and 24, 78 that can be manipulated as such, it becomes easy to install or remove the skins 22, 24 while the user is outside in cold temperatures, without removing his gloves or mittens. Indeed, the snap-fit resilient installation and removal of clips 76, 78 from decking 38 does not require simultaneous installation and removal of clips 76, 78 from skins 22, 24.

One particular use of snowshoe-ski kit 18 is for winter trekking on rolling hill terrain, with no or few steep slopes. In such terrain, the configuration of snowshoe-ski 20 with a low traction coefficient allows sliding over snow on flat ground and mild downhill slopes. On uphill slopes or steeper downhill slopes, skins 22, 24 can be installed with a selected surface 58, 60, 62, 64 exposed depending on the type of terrain and snow composition.

The invention claimed is:

1. A snowshoe-ski kit comprising:

A hybrid snowshoe-ski comprising a main body defining a front end, a rear end, a bottom surface operative for moving over snow and having a snowshoe-ski traction coefficient, and a top surface opposite the bottom surface, said hybrid snowshoe-ski further comprising a binding attached to said main body for attachment to a person's foot atop the top surface; and a first removable and reversible sheet-like skin having opposite first and second surfaces each defining respective first and second skin traction coefficients that differ from each other and that differ from the snowshoe-ski bottom surface traction coefficient; wherein the first skin is removably attachable to the snowshoe-ski main body with either one of the first and second surfaces bearing against the bottom surface and the other one of the first and second surfaces being exposed, for allowing the snowshoe-ski to be operatively used either alone or with the first skin installed with either one of the first and second skin surfaces exposed.

2. A snowshoe-ski kit as defined in claim 1, wherein the main body comprises a frame and a decking carried by the frame, the binding being attached to one or both of the decking and the frame and the first skin being removably attachable to one or both of the decking and the frame.

3. A snowshoe-ski kit as defined in claim 1, wherein the snowshoe-ski traction coefficient is lower than the traction coefficients of the first skin first and second surfaces for allowing sliding on snow when the snowshoe-ski is used without the first skin and for allowing a selectable enhanced traction when said snowshoe-ski is equipped with the first skin with either one of its first and second surfaces being exposed.

4. A snowshoe-ski kit as defined in claim 1, wherein the first skin is flexible and can conform to the shape of the bottom surface of the decking.

5. A snowshoe-ski kit as defined in claim 1, further comprising a second removable and reversible sheet-like skin having opposite first and second surfaces each defining respective first and second skin traction coefficients that differ from each other and that differ from the snowshoe-ski bottom surface traction coefficient, wherein the second skin is removably attachable to the snowshoe-ski main body with either one of the first and second surfaces bearing against the decking bottom surface and the other one of the first and second surfaces being exposed, for allowing the snowshoe-ski to be operatively used either alone, or with one or both the first and second skins being installed, with each of the first and second skins that is installed having one of their respective first and second skin surfaces exposed.

6. A snowshoe-ski kit as defined in claim 5, wherein said first and second skins are attachable to said snowshoe-ski in spaced apart configuration respectively frontwardly and rearwardly of the binding.

7. A snowshoe-ski kit as defined in claim 3, wherein the snowshoe-ski comprises a keel member on the bottom surface and the first skin is attachable at least partly to the keel member.

8. A snowshoe-ski kit as defined in claim 7, further comprising a first clip that is releasably attachable to both the first skin and the decking to attach the first skin to the decking.

9. A snowshoe-ski kit as defined in claim 8, wherein the decking comprises at least one decking opening to accommodate the first clip that is resiliently engageable within the decking opening, and the first skin comprises at least one first skin opening to accommodate the first clip that is resiliently engageable within the first clip opening.

10. A snowshoe-ski kit as defined in claim 9, wherein the first clip can be releasably connected to the first skin independently of the decking such that the first skin and first clip can be manipulated as a unit before the first skin is releasably attached to the snowshoe-ski.

11. A snowshoe-ski kit as defined in claim 6, wherein the snowshoe-ski comprises a keel member on the bottom surface and the first skin and second skins are attached at least partly to the keel member.

12. A snowshoe-ski kit as defined in claim 11, further comprising first and second clips that are releasably attachable to the decking and respectively to the first and second skins.

13. A snowshoe-ski kit as defined in claim 12, wherein the decking comprises decking openings to accommodate the first and second clips that are resiliently engageable within the decking openings, and the first and second skins comprise respective first and second skin openings to accommodate the first and second clips that are resiliently engageable within the first and second clip openings.

14. A snowshoe-ski kit as defined in claim 13, wherein the first and second clips can be releasably connected respectively to the first and second skins independently of the decking such that the first skin and the first clip can be manipulated as a first unit, and the second skin and the second clip can be manipulated as a second unit, before the first and second skins are releasably attached to the snowshoe-ski.

15. A snowshoe-ski kit as defined in claim 11, wherein the keel member comprises two spaced apart keel segments located on the decking bottom surface in spaced-apart configuration respectively frontwardly and rearwardly of the binding, with the first and second skins being attachable to a respective one of the first and second keel segments.

* * * * *